United States Patent [19]

Trayer et al.

[11] Patent Number: 5,058,216

[45] Date of Patent: Oct. 22, 1991

[54] APPARATUS FOR LOWERING TOILET SEAT

[76] Inventors: Jane S. Trayer; Frank C. Trayer, both of 25690 La Lanne Ct., Los Altos Hills, Calif. 94022

[21] Appl. No.: 434,529

[22] Filed: Nov. 7, 1989

Related U.S. Application Data

[63] Continuation-in-part of Ser. No. 229,123, Aug. 5, 1988, abandoned.

[51] Int. Cl.[5] ..... A47K 13/10

[52] U.S. Cl. ..... 4/251

[58] Field of Search ..... 4/249, 251, 253, 313; 60/533, 547.1, 593

[56] References Cited

U.S. PATENT DOCUMENTS

| | | | |
|---|---|---|---|
| 2,842,779 | 7/1958 | Zulkoski | 4/251 |
| 2,849,728 | 9/1958 | Gyllenberg | 4/251 |
| 2,945,566 | 7/1960 | Sanford et al. | 60/547.1 X |
| 3,781,924 | 1/1974 | Davis, Jr. | 4/251 |
| 4,103,371 | 8/1978 | Wilson | 4/251 |
| 4,433,442 | 2/1984 | Liou | 4/251 |
| 4,577,350 | 3/1986 | Clark | 4/251 |
| 4,729,224 | 3/1988 | McAteer | 60/593 |

FOREIGN PATENT DOCUMENTS 67372 7/1948 Denmark .

*Primary Examiner*—Henry J. Recla
*Assistant Examiner*—Casey Jacyna
*Attorney, Agent, or Firm*—Schapp and Hatch

[57] ABSTRACT

Apparatus for lowering the seat or seat and lid of a flush toilet in response to the flushing of the toilet, including an impulse converter which is connected to a discharge pipe or port of the float valve of the toilet and serves to convert the water impulses resulting from the flushing of the toilet to air impulses for inflating a bladder which is positioned to impel the seat or seat and lid of the toilet out of the stable upright position when inflated. In particular versions of the disclosed apparatus the bladder is mounted between the front wall of the flush tank and the raised lid of the toilet and the air impulses are conveyed from the impulse converter located in the flush tank to the bladder by means of a tube which passes between the lid of the flush tank and the upper edge of the front wall of the flush tank.

18 Claims, 5 Drawing Sheets

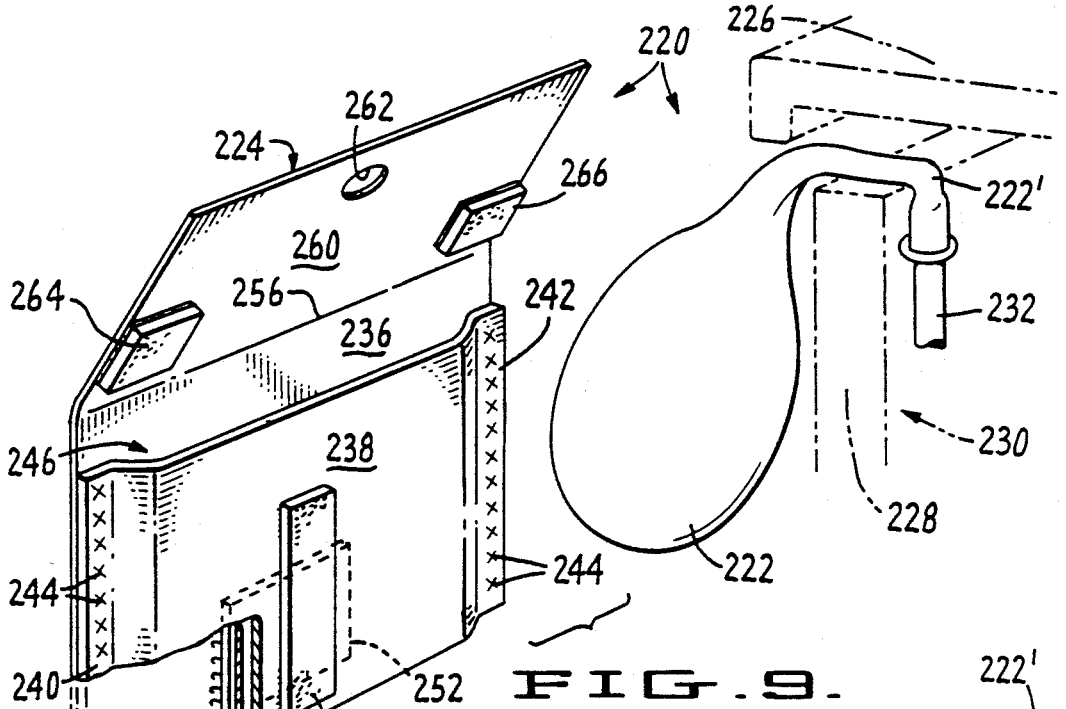
FIG. 9.
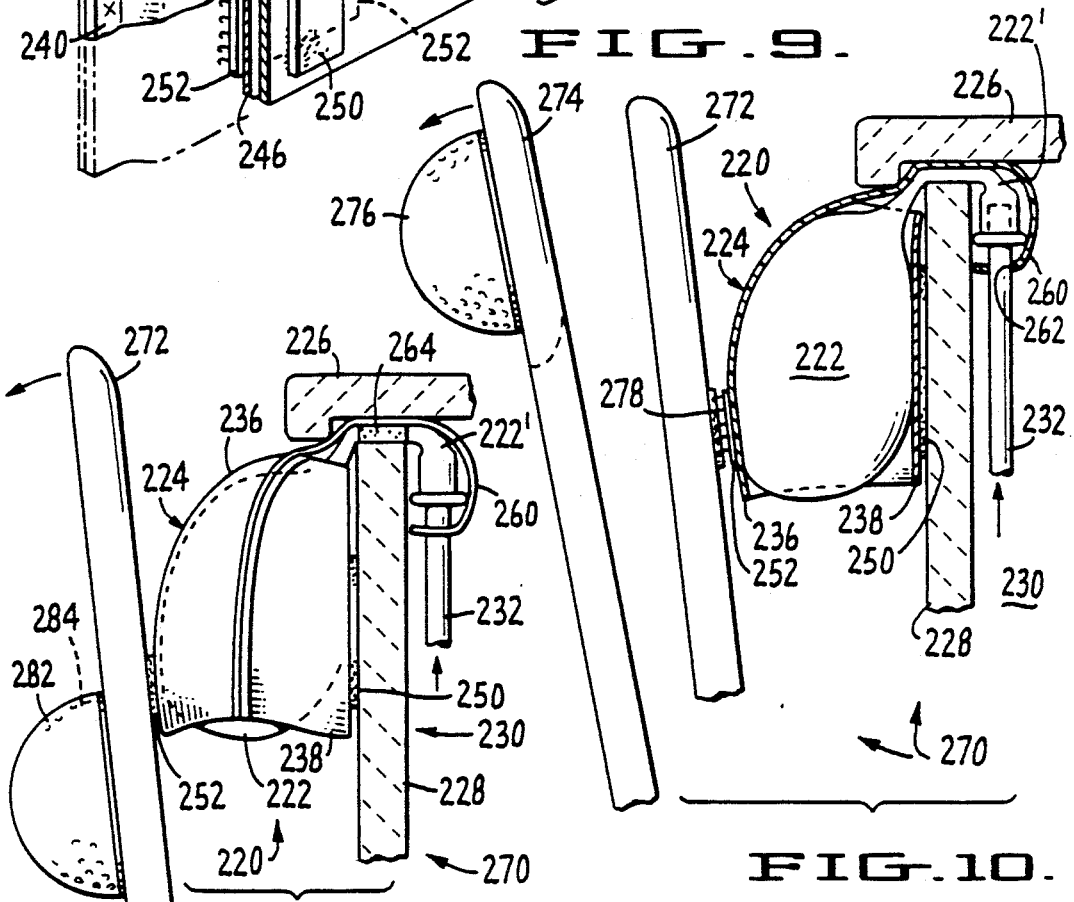
FIG. 10.
FIG. 11.

APPARATUS FOR LOWERING TOILET SEAT

This is a continuation-in-part of co-pending application Ser. No. 07/229,123 filed on Aug. 5, 1988 now abandoned.

BACKGROUND OF THE INVENTION

1. Field of the Invention

Our invention relates to apparatus for lowering lifted toilet seats, and more particularly to apparatus for automatically lowering a lifted toilet seat, or toilet seat and cover, in response to the flushing of the toilet.

2. Description of the Prior Art

Apparatus for lowering toilet seats are well known in the prior art.

U.S. Pat. No. 4,577,350, issued Mar. 25, 1986, discloses a device for automatically returning a lifted toilet seat, or a lifted toilet seat and its cover, to its normal lowered or horizontal position on the toilet bowl. More particularly, the device disclosed in this patent is an easily mountable device for automatically returning a lifted toilet seat or seat and cover to the lowered position after the elapse of a predetermined interval from the time when the seat or cover is lifted.

U.S. Pat. No. 4,433,442, issued Feb. 28, 1984, discloses a device for operating the seat and cover of a flush toilet, comprising a pair of floats installed in the flush tank which are operatively connected with the toilet seat and cover. The disclosed device further comprises holding levers adapted to hold the floats submerged in the water in the flush tank. The holding levers are operable by hand to release the floats, thus allowing the floats to buoy up or ascend, and consequently to raise the seat and cover, which are subsequently lowered when the water in the flush tank is drained during a conventional toilet flushing operation.

Foot-actuated toilet seat operating devices are disclosed in U.S. Pat. Nos. 2,842,779; 2,849,728; and 4,103,371, and in Danish Patent No. 67,372.

It is believed, however, that none of the apparatus disclosed in these patents achieves the several objects of our present invention, or does so with the economy of manufacturer and ease of installation which are characteristic of our invention.

For example, the apparatus of said U.S. Pat. No. 4,577,530 is limited in its application to toilets in which the clearance space between the flush tank and the lid or seat cover in its stable upright position is great enough to accommodate collapsible and expandable device 26. In many currently marketed toilets, however, this clearance space is very narrow.

Further, the fact that the device of said U.S. Pat. No. 4,577,530 operates after a fixed time interval following the lifting of the toilet lid gives rise to the possibility that the lid may be lowered while the toilet is being used as a urinal, resulting in spillage of urine outside the toilet bowl.

Yet further, it is evident that expandable device 26 would be very annoying, if not outright uncomfortable, to a person seated on lid 18 if the device of the patent were installed as illustrated therein. If, on the other hand, device 26 were suspended from lid 18, to operate seat 16 only, device 26 would obviously cause considerable discomfort to persons seated on seat 16. Also, it appears that if device 26 were suspended from seat 18 it would drop into the toilet bowl, or at least be awkward to handle when lid 18 is lowered.

The apparatus of said U.S. Pat. No. 4,433,442 is very complex as compared with the apparatus of the present invention, and involves modification of the flush tank (to accommodate levers 51, 52, and 53), making the device of said U.S. Pat. No. 4,433,442 not only more expensive to fabricate but also more difficult to install. Indeed, it would appear that the apparatus of said U.S. Pat. No. 4,433,442 would require the services of a plumber for its correct installation.

Further, the operation of the apparatus of said U.S. Pat. No. 4,433,442 is more difficult and subject to error than the operation of the apparatus of our invention, in that the operation of the device of the 4,433,442 patent involves the manipulation of three levers, 51, 52, 53, whereas the operation of the apparatus of our invention does not involve the manipulation of any additional levers or other control means.

The foot-actuated toilet seat operating devices of U.S. Pat. Nos. 2,842,779; 2,849,728; and 4,102,371; and of Danish Patent No. 67,372, all operate in a manner completely different from that of the apparatus of our invention. None of these devices operates automatically in response to the flushing of the toilet as do the devices of our invention.

The term "prior art" as used herein or in any statement made by or on behalf of applicants means only that any document or thing referred to as prior art bears, directly or inferentially, a date which is earlier than the effective filing date hereof.

No representation or admission is made that any of the United States and foreign patents discussed hereinabove is part of the prior art, or that no more pertinent information exists.

SUMMARY OF THE INVENTION

Accordingly, it is an object of our invention to provide apparatus for lowering the manually lifted seat or sear and lid of a toilet, which apparatus operates automatically in response to the flushing of the toilet equipped therewith. Such apparatus will sometimes hereinafter be called "flush-operated toilet seat lowering apparatus", and a toilet equipped therewith will be called an "equipped toilet".

Another object of our invention is to provide flush-operated toilet seat lowering apparatus which can be quickly installed in the equipped toilet by persons having substantially no mechanical training or experience.

Yet another object of our invention is to provide flush-operated toilet seat lowering apparatus which can be installed in the equipped toilet with only commonly available tools, such as a pair of common kitchen shears.

A further object of our invention is to provide flush-operated toilet seat lowering apparatus which can be installed in the equipped toilet without modifying the equipped toilet.

A yet further object of our invention is to provide flush-operated toilet seat lowering apparatus which can be cheaply and easily fabricated, and can be packed in a small, compact package for ease and economy of shipping and storage.

An additional object of our invention is to provide flush-operated toilet seat lowering apparatus which does not impede the manual raising of the toilet seat into its stable upright position.

Another object of our invention is to provide flush-operated toilet seat, apparatus which is adapted for quick and easy installation in a wide variety of flush-toilets.

Yet another object of our invention is to provide flush-operated toilet seat lowering apparatus which can be installed without passing any part thereof behind the flush tank of the equipped toilet.

A further object of our invention is to provide flush-operated toilet seat lowering apparatus in which the toilet seat actuating bladder is mounted on the front wall of the flush tank without modifying the flush tank.

A yet further object of our invention is to provide flush-operated toilet seat lowering apparatus which may be selectively arranged to automatically lower the toilet seat only or the toilet seat and the toilet lid when the toilet is flushed.

Other objects of our invention will in part be obvious and will in part appear hereinafter.

Our invention, accordingly, comprises the apparatus embodying features of construction, combinations of elements, and arrangements f parts, all as exemplified in the following disclosure, and the scope of our invention will be indicated in the appended claims.

In accordance with a principal feature of our invention, the seat actuator of a flush-operated toilet seat lowering apparatus, which impels the toilet seat or toilet seat and cover from the stable upright position, is powered by air impulses which result from the flushing of the toilet.

In accordance with another principal feature of our invention, said air impulses are provided by an impulse converter which is itself a principal feature of our invention and which converts water impulses resulting from the flushing of the toilet into corresponding air impulses.

In accordance with yet another principal feature of our invention, said impulse converter is adapted to be located inside the flush tank of the equipped toilet, at least in part beneath the standing water level therein.

In accordance with an additional principal feature of our invention, said impulse converter is adapted to be mounted on the standpipe of the flush tank of the equipped toilet by means of suitable bands of resilient material or the like.

In accordance with a yet further feature of our invention, the toilet seat actuator portion of the apparatus of our invention is comprised of an elongated plastic strip assembly defining a channel for guiding the outer end of the air tube connected to the impulse converter, a pocket adapted for containing a bladder which is air-tightly connected to the outer end of said air tube, and double sided tape strips and associated Velcro strips adapted for adhering said plastic strip assembly to the lid of the equipped toilet.

In accordance with another principal feature of our invention, which feature is exemplified in the third preferred embodiment of our invention, the toilet seat actuator portion of the apparatus of our invention is comprised of a balloon-like inflatable bladder having a main body portion and a neck portion through which the main body portion can be inflated, said bladder being operatively located near the upper edge of the front wall of the flush tank of the equipped toilet and said neck portion passing between said upper edge and the lid of said flush tank.

In accordance with yet another principal feature of or invention, which is also exemplified in the third preferred embodiment of our invention, the inflatable bladder of the third preferred embodiment is contained in a sheath which is itself adhered to the front wall of the flush tank of the equipped toilet, the outer wall of the sheath remote from the front wall of the flush tank including an extended tongue portion which operatively passes between the flush tank lid and the front wall of the flush tank, said sheath being so constructed and arranged that said outer wall is thrust away from the front wall of the flush tank when the bladder is inflated.

In accordance with an additional principal feature of our invention, at least one of the walls of said sheath is semi-rigid, and thus is capable of deflating said bladder when inflating pressure is not applied via the neck of said bladder.

In accordance with another principal feature of our invention, said tongue of the front wall of said sheath is provided with at least two spacers which are operatively located between the upper edge of the front wall of the flush tank of the equipped toilet and the lid thereof, and thus prevent the bladder neck from being pinched off by the weight of the tank lid.

In accordance with yet another principal feature of our invention, said tongue of said sheath is provided with an aperture adapted to operatively surround the inflating tube which extends between the neck of the bladder and the associated impulse converter.

In accordance with a further principal feature of our invention, said front wall of said sheath is provided with an outwardly facing patch of pileate fastener material, preferably of the "loop" type or a permanent magnet.

In accordance with a yet further principal feature of our invention, which is exemplified in the first variant of the third preferred embodiment of our invention, a patch of pileate fastener material adapted to coact with said outwardly facing patch of pileate fastener material or a plated steel disc is affixed to the top of the lid of the equipped toilet, whereby said lid is prevented from falling into its horizontal, toilet closing, position when said bladder is inflated.

In accordance with another principal feature of our invention, said pileate fastener material or said plated steel disc, adhered respectively to the top f the lid of the equipped toilet, are not included in a second variant of the third preferred embodiment of our invention, and thus, in said second variant, both the seat and the lid of the equipped toilet fall into their horizontal positions of rest when they are in their upright positions of rest and said bladder is inflated.

In accordance with a yet further principal feature of our invention, some embodiments of our invention may comprise replacement toilet lids into which a toilet seat actuator of our invention is incorporated at the time of manufacture.

In accordance with an additional feature of our invention, some embodiments of our invention may employ water from the flush tank as the operating fluid for the toilet seat actuator, thereby eliminating the need for the impulse converter.

In accordance with another principal feature of our invention, the impact of the toilet seat upon the toilet bowl rim is damped by one or a plurality of resilient bumpers or silencing pads affixed at suitable locations to the lower surface of the toilet seat.

In accordance with yet another principal feature of our invention, said bumpers or silencing pads may be replaced with air-filled pillows which are inflated by each air impulse from the impulse converter. Suitable valving may be provided to permit these pillows to fill with air quickly but to be emptied of air slowly, by discharging the pillows through an adjustable restrictor which controls the return of air from the pillows to the air chamber of the impulse converter.

For a fuller understanding of the nature and objects of our invention, reference should be had to the following detailed description, taken in connection with the accompanying drawings.

BRIEF DESCRIPTION OF THE DRAWINGS

FIG. 9 is an exploded perspective view of the bladder and the bladder sheath of the third preferred embodiment of our invention, juxtaposed in operative relation to the upper edge of the front wall of the flush tank of the equipped toilet and the lid of the flush tank of the equipped toilet;

FIG. 10 is a partial elevational view, partly in section, of a toilet equipped with apparatus of the first variant of the third preferred embodiment of our invention; and FIG. 11 is a partial elevational view, partly in section, of a toilet equipped with apparatus of the second variant of the third preferred embodiment of our invention.

DESCRIPTION OF THE PREFERRED EMBODIMENTS

Figure 1:
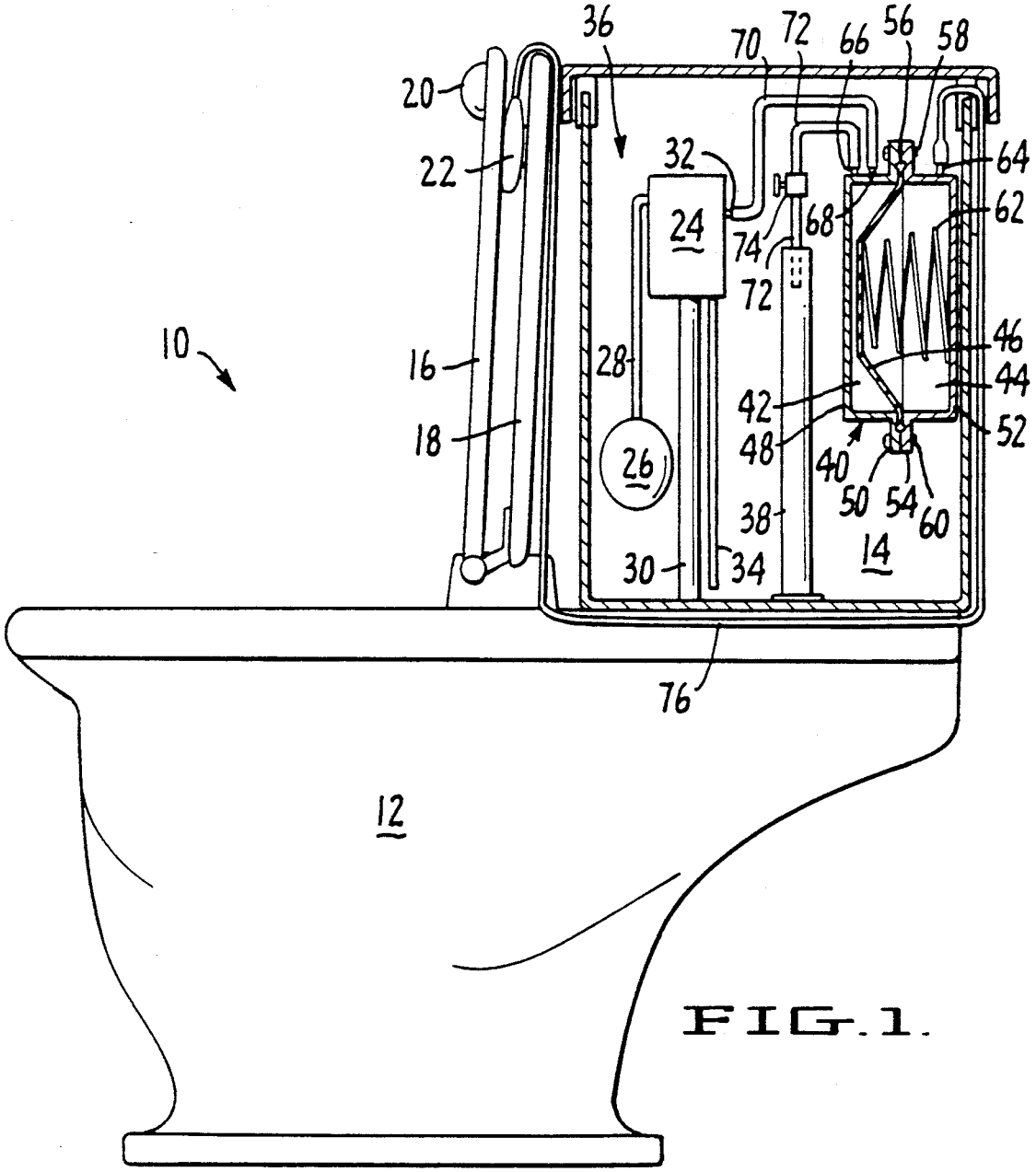
FIG. 1 is a schematic view of an apparatus embodying our invention, including the flush toilet to which said apparatus is applied.

Referring now to FIG. 1, there is shown a flush toilet 10 equipped with apparatus for lowering the seat thereof, which apparatus is constructed in accordance with our invention.

It is to be understood that FIG. 1 is schematic only, and thus is intended to illustrate the operating principles of our invention and not to show a preferred structural embodiment thereof.

In the well known manner, flush toilet 10 is comprised of a bowl 12 and a flush tank 14.

Also in the well known manner, bowl 12 is provided with a seat 16 and a lid 18, both of which are pivotably mounted on bowl 12.

As will be understood by those having ordinary skill in the art, seat 16 and lid 18 are shown in FIG. 1 in their respective stable upright positions.

In accordance with the principles of our invention, an impact damper 20 is affixed to the lower face of seat 16, as by cementing. Impact damper 20 may, for example, be a body of resilient material, such as rubber or a suitable plastic material, or may be a closed, hollow capsule of such material.

As further seen in FIG. 1, an inflatable bladder 22 is disposed between seat 16 and lid 18, which inflatable bladder is a principal operating element of the system of our invention as illustrated in FIG. 1.

For ease of comprehension, the anchoring means for maintaining bladder 22 in position on lid 18 are not shown in the schematic diagram of FIG. 1. A particularly effective form of such anchoring means, which constitute a principal feature of our invention, are shown herein in FIGS. 4 through 7, and described in the present specification in connection therewith.

As also seen in FIG. 1, flush tank 14 contains a float valve 24 and its operating float 26, which is operatively coupled to float valve 24 by a float arm 28. Float valve 24, float 26, and float arm 28 are all of conventional type, well known to those having ordinary skill in the flush toilet art, and coact in the well known manner.

Also in the well known manner, float valve 24 is fixedly mounted on the bottom of flush tank 14 by means of a conventional pedestal 30, which in some cases may be integral with the body of flush valve 24.

As will be evident to those having ordinary skill in the flush toilet art, informed by the present disclosure, flush valve 24 is provided with two discharge pipes 32, 34. Discharge pipe 34 is the tank filler pipe, which serves to provide the water by which tank 14 is refilled after each flush. Discharge pipe 32 is the bowl filler pipe by which bowl 12 is refilled after each flush.

Float valve 24, float 26, float arm 28, pedestal 30, bowl filler pipe 32, and tank filler pipe 34 will sometimes herein be collectively designated as float valve assembly 36. It will be understood by those having ordinary skill in the flush toilet art that flush valve assembly 36 will take many different forms, depending upon the manufacturer's design and the particular flush toilet to which that design is adapted. It is a particular feature of our invention that the devices thereof are adapted to cooperate with a very wide variety of float valve assemblies without modification, and to cooperate with an even wider variety of float valve assemblies with very little modification of a type easily carried out by the householder utilizing our invention.

Also located in flush tank 14 is a well known standpipe 38 of conventional design.

As is well known to those having ordinary skill in the art, standpipe 38 is affixed to and passes through the bottom of flush tank 14, and is coupled to and serves as the upper end of the refill pipe or tube by means of which bowl 12 is refilled with water after each flush.

In the conventional arrangement of flush tank 14, discharge pipe 32 of float valve 24 is coupled to the interior of standpipe 38 by means of a suitable tube or other conduit.

In accordance with the teachings of our invention, an impulse converter 40 constructed in accordance with the principles of our invention (and shown in greater detail in FIGS. 2 and 3) is suspended on the rear wall of tank 14. In the preferred embodiment of our invention impulse converter 40 is mounted on standpipe 38, rather than on the rear wall of tank 14 as shown schematically in FIG. 1.

As also shown schematically in FIG. 1, impulse converter 40 is a closed, sealed vessel the interior of which is subdivided into two chambers or compartments 42, 44 by means of a displaceable diaphragm 46.

The outer wall of chamber 42 is a dish member 48 the outer lip of which is a flat, circular flange 50.

The outer wall of chamber 44 is a dish member 52 the outer lip of which is a flat, circular flange 54.

Diaphragm 46 is provided with an outer flat, circular edge portion 56 which is of substantially the same shape and size as flanges 50 and 54.

As seen in FIG. 1, circular outer portion 56 of diaphragm 46 is captive between flanges 50 and 54, which are themselves fastened together by a plurality of suitable fasteners 58, 60, etc. By means of these fasteners flanges 50, 54 and edge portion 56 are joined together in fluid tight manner.

A coil spring 62 is provided in chamber 44, which coil spring resiliently urges diaphragm 46 into chamber 42.

The only fluid access to chamber 44 is via stub pipe 64, which is integral with dish member 52. Similarly, the only fluid access to chamber 42 is via stub pipes 66 and 68, which are integral with pan member 48.

It is also to be noted that diaphragm 46 completely seals the interior of chamber 42 from fluid communication with the interior of chamber 44.

Referring again to FIG. 1, it will be seen by those having ordinary skill in the art that a tube 70 extends between bowl filler pipe 32 of float valve 24 and stub pipe 68 of impulse converter 40.

Thus, it will be seen by those having ordinary skill in the art that during each flushing of toilet 10 the water stream from float valve 24 which in conventional flush toilets is directed into standpipe 38 is instead directed into water chamber 42 of impulse converter 40.

As also seen in FIG. 1, a tube 72 extends between stub pipe 66 of impulse converter 40 and the interior of standpipe 38 manually variable flow restrictor 74, such as a suitable clamp, is incorporated into tube 72.

Thus, it will be seen by those having ordinary skill in the art that whenever toilet 10 is flushed a pulse of water entering water chamber 42 via tube 70 drives diaphragm 46 toward air chamber 44 against the urging of coil spring 62, resulting in the emission of an air pressure pulse from impulse converter 40 via stub pipe 64.

Subsequently, the water thus injected into water chamber 42 via tube 70 is drained into standpipe 38 via tube 72 over a time period determined by the setting of flow restrictor 74, at the end of which time period diaphragm 46 will have returned to its normal position schematically illustrated in FIG. 1. (Flow restrictor 74 is manually set to a point of optimum system operation at the time of the installation of the system of our invention in toilet 10.)

As further seen in FIG. 1, a tube 76 extends from stub pipe 64 of impulse converter 40 to the input orifice of inflatable bladder 22. Tube 76 is joined in substantially airtight manner to stub pipe 64 and to the input orifice of inflatable bladder 22, and thus each air pressure impulse emitted from stub pipe 64 of pulse converter 40 causes bladder 22 to expand, and thus to impel toilet seat 16 from its stable upright position, if it is in that position.

Thus, it will be seen by those having ordinary skill in the flush toilet art, informed by the present disclosure, that the apparatus of our invention shown in FIG. 1, when it is installed in toilet 10 as shown in FIG. 1, causes toilet seat 16 to be impelled from its upright stable position, if it is in that position, each time toilet 10 is flushed, whereupon toilet seat 16 falls into its lowered or operative position on the upper face of toilet bowl 12, which fall is damped by damper 20.

Figure 2:
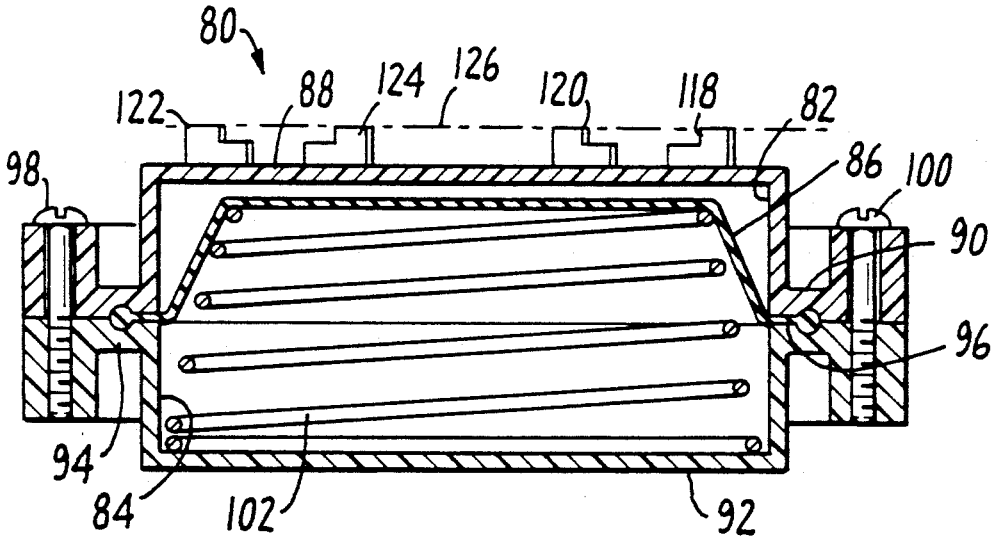
FIG. 2 is a vertical sectional view of an impulse converter constructed in accordance with our invention.
Figure 3:
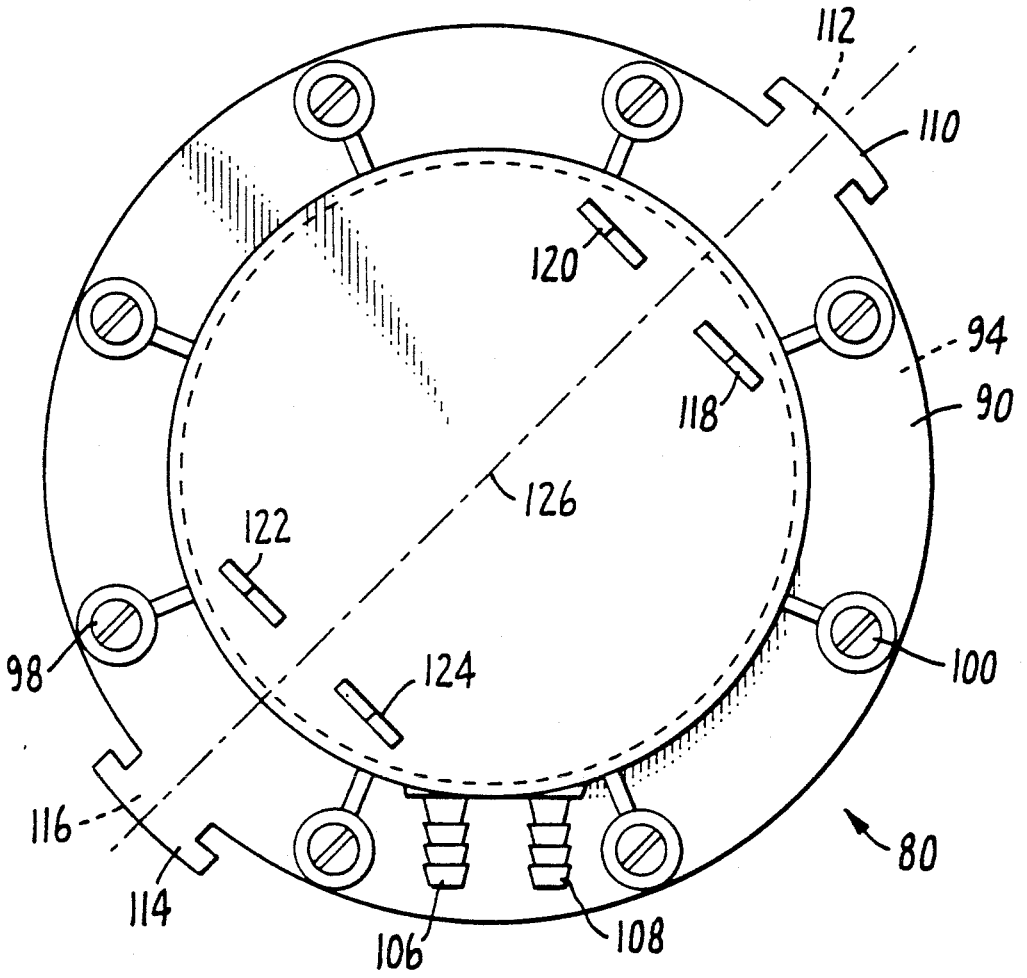
FIG. 3 is a plan view of the impulse converter of FIG. 2.

Referring now to FIGS. 2 and 3, there is shown an impulse converter 80 which is constructed and arranged in accordance with a first preferred embodiment of our invention.

This first preferred embodiment of our invention is generally substantially equivalent to the embodiment of our invention schematically shown in FIG. 1, except as specifically shown in FIGS. 2 through 7 and described hereinafter in connection with those figures of the drawings.

Referring again to FIGS. 2 and 3, it is to be particularly noted that the parts of the impulse converter of FIGS. 2 and 3 are identified by reference numerals which are equal to reference numerals designating the corresponding parts of the impulse converter shown in FIG. 1 with 40 added thereto.

Thus, the impulse converter shown in FIG. 1 is identified by the reference numeral 40, whereas the impulse converter of FIGS. 2 and 3 is identified by the reference numeral 80. Similarly, the coil spring of the impulse converter or FIG. 1 is identified by the reference numeral 62, whereas the coil spring of the impulse converter of FIGS. 2 and 3 is identified by the reference numeral 102; and the diaphragm of the impulse converter of FIG. 1 is identified by the reference numeral 46, whereas the diaphragm of the impulse converter of FIGS. 2 and 3 is identified by the reference numeral 86.

Referring again to FIGS. 2 and 3, it will be seen that dish members 88 and 92 of impulse converter 80 are molded, e.g., from a suitable non-corrosible plastic material.

Dish members 88, 92 are fastened together to clampingly engage the flange 96 of diaphragm 86 by means of suitable stainless steel screws 98, 100, etc., or the like.

As also seen in FIGS. 2 and 3, impulse converter 80 is provided with mounting means for rapidly and easily mounting it on the standpipe of the equipped flush toilet, which mounting means are principal features of our invention.

Said mounting means include four ears, 110, 112, 114, 116, each of which projects from the outer edge of one of the flanges 90, 94 of dish members 88, 92. As seen in FIG. 3, ears 110, 112 overlie each other and ears 114, 116 overlie each other.

Said mounting means also include four ears 118, 120, 122, 124, which are raised upon the central, flat outer surface of dish member 88. These ears are so constructed and arranged that they can all bear against the outer surface of the standpipe when impulse converter 80 is correctly oriented and brought into contact with the standpipe.

In accordance with this feature of our invention impulse converter 80 is mounted upon the standpipe of a flush toilet by (1) passing a suitable rubber band over ears 110, 112 so that it becomes locked on those ears, (2) passing a corresponding rubber band over ears 114, 116 so that it becomes locked on those ears (3) aligning the axis 126 of said ears with the standpipe, and (4) passing said rubber bands over the standpipe so that they frictionally engage impulse converter 80 with the surface of the standpipe.

Referring now to FIGS. 4 through 7, there is shown the toilet seat actuator 130 of the first preferred embodiment of our invention.

Figure 4:
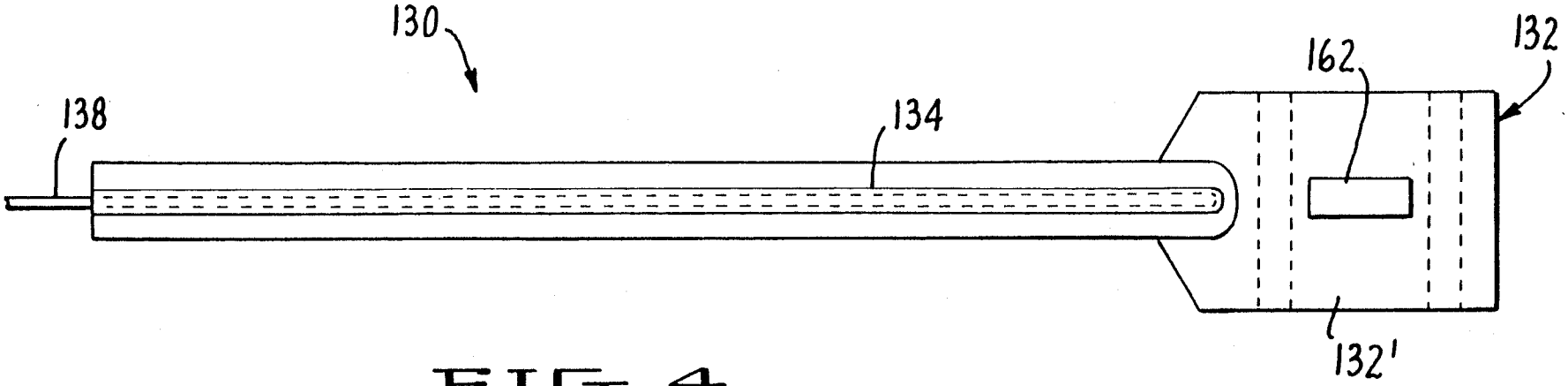
FIG. 4 is a plan view of a toilet seat actuator constructed in accordance with our invention.

The main body member 132 of seat actuator 130 is a sheet of plastic material, such as textured white vinyl sheeting approximately 0.02" thick, contoured as seen in FIG. 4.

Figure 5:
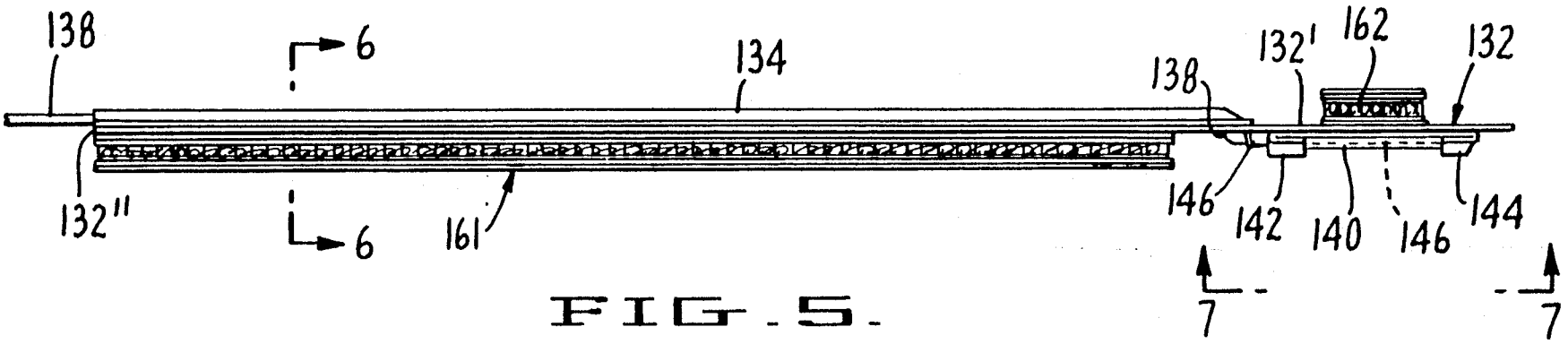
FIG. 5 is an elevational view of the toilet seat actuator of FIG. 4.

As may be seen by comparison of FIGS. 4 and 5, main body member 132 is comprised of a head portion 132' and a tail portion 132".

Figure 6:
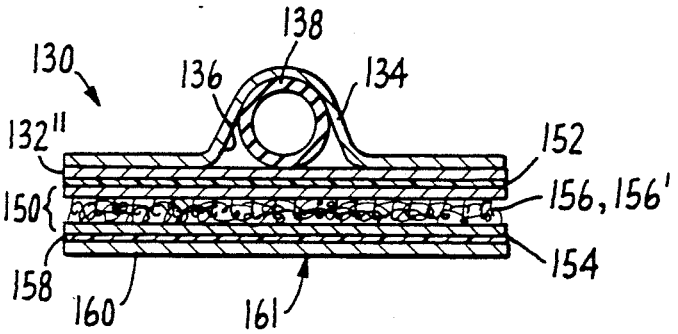
FIG. 6 is a transverse sectional view of the toilet seat actuator of FIGS. 4 and 5, taken on plane 6—6 of FIG. 5.

A supply tube guide 134, which is a sheet of the same plastic material contoured as shown in FIGS. 4, 5, and 6, is adhered to main body member 132 to form a passageway 136 (FIG. 6) adapted to receive a supply tube 138 (corresponding to supply tube 76 of FIG. 1) which conveys the air impulses from impulse converter 80.

A bladder retainer 140, formed from the same type of sheet material, is adhered to the lower face of head portion 132' of main body portion 132, as seen in FIG. 5.

Bladder retainer 140 is formed by first folding two opposite edge portions back onto the main body portion of the sheet from which it is fabricated, and then adhering those opposite edge portions to the main body portion thereof to provide hems 142, 144, and thus to rigidify bladder retainer 140. Bladder retainer 140 is then adhered to head portion 132' of main body member 132 along their common outer edges in order to provide a receptacle for receiving bladder 146 (FIG. 7).

Figure 7:
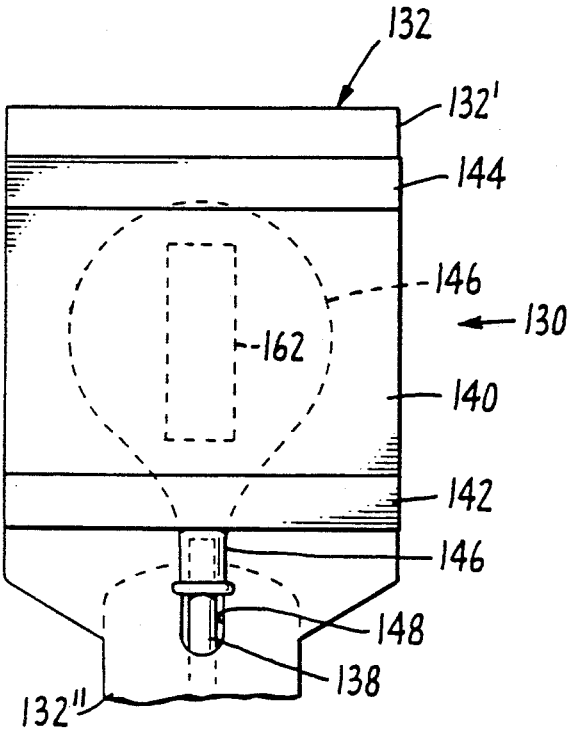
FIG. 7 is a partial view of the toilet seat actuator of FIGS. 4 and 5, taken on plane 7—7 of FIG. 5.

As best seen in FIG. 7, impulse supply tube 138, after passing through passageway 136, passes through an opening 148 in main body member 132, and then is engaged with the mouth portion of bladder 146. The end of impulse supply tube 138 is adhered to the mouth portion of bladder 146 in airtight fashion.

As will now be evident to those having ordinary skill in the art, informed by the present disclosure, an air impulse supplied via a supply tube 138 can momentarily inflate bladder 146, but in the absence of such air impulses the stiffness of hems 142, 144 will quickly, resiliently urge bladder 146 to resume its flat, empty condition.

As best seen in FIG. 6, a Velcro or similar pileate fastener 150 is adhered to the face of tail portion 132" opposite passageway 136. In the well known manner, Velcro fastener 150 is comprised of an upper substrate 152 and a lower substrate 154, between which the well known hook and pile members 156, 156' are disposed and mutually engaged.

A layer of pressure sensitive adhesive 158 is provided on the outer face of substrate 154, and a covering tape 160 is applied over adhesive 158.

This assembly of elements 150, 152, 154, 156, 156', 158, 160 will sometimes be designated as fastening assembly 161 herein.

As seen in FIGS. 4 and 5, a similar fastening assembly 162 of much smaller area is applied to the upper face of head 132'.

In accordance with our invention seat actuator 130 is preferably applied to the lid of the toilet equipped with our invention but first removing covering tape 160 and then adhering tail portion 132" to the upper side of the horizontally disposed lid with the major part of head portion 132' extending beyond the central portion of the outer edge of the lid.

The covering tape of fastening assembly 162 is then removed, and head portion 132' is folded over the outer edge of the lid and adhered to the underside of the lid, thus fixedly disposing bladder 146 in substantially the same position occupied by bladder 22 in FIG. 1.

The provision of the Velcro fastener portions of fastening assemblies 161 and 162 makes it possible to conveniently remove seat actuator 130 from its associated lid for cleaning.

It will be understood by those having ordinary skill in the art that in certain embodiments of our invention the fastening assemblies may be fabricated from commercially available components, such as double-sided tape, rather than depositing the individual layers described hereinabove.

It is further to be understood that our invention is not limited to toilet seat lowering apparatus comprising Velcro or other plate fasteners.

Figure 8:
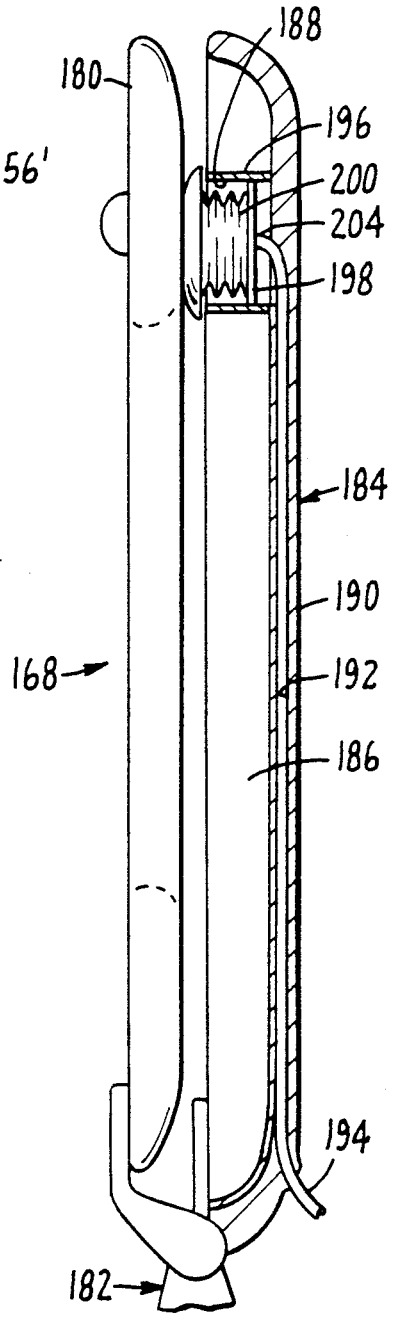
FIG. 8 is a sectional view in elevation of a toilet seat and lid assembly constructed in accordance with our invention.

Referring now to FIG. 8, there is shown the combined toilet lid and seat actuator of the second preferred embodiment of our invention.

It is to be understood that the complete system of the second preferred embodiment of our invention is substantially identical to the system of the first preferred embodiment of our invention, except that the combined lid and seat actuator of FIG. 8 is substituted for the conventional lid and the seat actuator of our invention which are parts of the system of the first preferred embodiment.

As seen in FIG. 8, the toilet lid and seat assembly 168 of the second preferred embodiment of our invention is comprised of a conventional toilet seat 180, a conventional toilet seat and lid hinge assembly 182, and a toilet lid 184 embodying our invention.

Lid 184 is comprised of a core 186 which in general resembles a conventional toilet lid in its unfinished, i.e., unpainted, state.

In accordance with our invention core 186 is provided with a bore 188 which is of circular cross-section and extends completely through core 186.

Further in accordance with our invention core 186 is covered with an outer covering 190 which in the second preferred embodiment of our invention is comprised of an inner layer of foam padding material and an outer layer of flexible plastic material.

As also seen in FIG. 8, said inner layer of foam plastic material is provided with an inner passageway 192 which contains an air impulse supply tube 194 adapted to convey air impulses from an associated impulse converter of our invention, such as that shown in FIGS. 2 and 3.

Disposed in close fitting relationship in bore 188 is a sleeve 196 to the interior of which is affixed a bracket 198.

A sylphon bellows 200 is mounted on bracket 198, and is provided with a shoe 202 at its outer end.

Sylphon bellows 200 is also provided with a stub pipe 204 which receives the associated end of air impulse supply tube 194. Bellows 200 is completely airtightly sealed but for stub pipe 204, and thus each air impulse received via supply tube 194 causes bellows 200 to expand longitudinally, moving foot 202 outwardly to a sufficient extent to impel toilet seat 170 out of its stable upright position, and thus to lower toilet seat 170 to its position of rest on its associated toilet bowl.

While the system of our invention described schematically in FIG. 1 and the system of the first preferred embodiment of our invention disclosed herein are both adapted to lower only the seat of the equipped toilet and not the associated lid, it is to be understood that our invention also embraces systems in which the seat actuator is disposed on the front face of the flush tank and so located that it acts to lower both the seat and the lid.

Referring now to FIG. 9, thee is shown the actuator 220 of the third preferred embodiment of our invention.

As seen in FIG. 9, actuator 220 is comprised of an inflatable bladder 222 and a sheath 224 adapted to contain bladder 222.

Also shown in FIG. 9, in phantom, is the lid 226 and the front wall 228 of tank 230 of the equipped toilet.

Bladder 222 is shown in its operative position, in which its neck 222' passes between lid 226 and the upper edge of front wall 228.

The outer end of neck 222' is passed over and frictionally engaged with the upper end of an inflating tube 232. Inflating tube 232 serves the same purpose as inflating tube 76 shown in FIG. 1.

It is to be understood that the apparatus of the third preferred embodiment of our invention differs from the apparatus of the first preferred embodiment only in the construction of the actuator. That is to say, the apparatus of the second preferred embodiment of our invention can be changed to the apparatus of the third preferred embodiment by substituting actuator 220 of FIGS. 9 through 11 for actuator 130 of FIGS. 4 through 7.

Referring again to FIG. 9, it will be seen that sheath 224 is comprised of a larger panel 236 of sheet material and a smaller panel 238 of sheet material. In the third preferred embodiment of our invention the sheet material of panel 236 is preferably 0.012 inch thick textured flexible polyvinylchloride sheet material. Panel 236 is approximately 4 ½ inches wide and 6 ¼ inches high. The sheet material of smaller panel 238 is preferably 0.015 inch thick semi-rigid thermally formable polyvinylchloride sheet material. Panel 238 is approximately 4 ½ inches wide and 3 ½ inches high.

Panel 238 is so thermally formed that when joined to panel 236 in the manner shown in FIG. 9 only the outer vertical edge portions 240, 242 thereof contact panel 236. As also seen in FIG. 9, said outer vertical edge portions 240, 242 are both joined to corresponding edge portions of panel 236 by means of thermal welds 244.

By this construction a receptacle 246 is formed between panels 236 and 238, which receptacle is adapted to embracingly receive bladder 222.

Referring again to FIG. 9, it will be seen that a strip 250 of double-sided adhesive tape is adhered to the central portion of the side of panel 238 remote from panel 236. A preferred material for strip 250 is ½ inch wide double-sided adhesive tape of the kind made and sold by the 3M Company, which is provided with a protective cover strip adapted to be removed when it is desired to secure strip 250, and thus sheath 224, to the outer face of the front wall of toilet tank 230.

A small portion 252 of pileate fastener material, sold, for example, under the trade name VELCRO, is adhered to the face of panel 236 remote from panel 238. This pileate fastener material is preferably of the "loop" type and may be one inch wide and one inch high.

As further seen in FIG. 9, a bend 256 extends from side to side of panel 236. The portion of panel 236 above bend 256 acts as a hinged tongue 260 the purpose of which will be explained hereinbelow in connection with FIGS. 10 and 11.

Tongue 260 is provided with a circular aperture 262 the purpose of which will be described hereinbelow in connection with FIGS. 10 and 11.

A pair of spacer blocks 264, 266 are adhered to tongue 260 as shown in FIG. 9, which spacer blocks are operatively located between tank lid 226 and tank wall 228 to space them apart and thus to avoid constricting or completely occluding neck 222' of bladder 222.

Referring now to FIG. 10, there is shown in part a toilet 270 which includes flush tank 230, lid 272, and seat 274.

Lid 272 and seat 274 are hinged to the associated toilet bowl in the usual manner, and flush tank 230 contains the operative parts of the usual flush tank and the operative parts of the apparatus of our invention shown in FIG. 1. In toilet 270 however, inflating tube 232 shown in FIG. 10 is substituted for inflating tube 76 of FIG. 1. Thus, it will be understood by those having ordinary skill in the art, informed by the present disclosure, that each time toilet 270 is flushed an inflating impulse is supplied to bladder 222 from an impulse converter 240 (not shown) by way of inflating tube 232. Impulse converter 240 is substantially identical to impulse converter 40 of FIG. 1.

An impact damper 276 substantially identical to impact damper 20 of FIG. 1 is adhered to the lower face of toilet seat 274.

As also seen in FIG. 10, a patch 278 of pileate fastener material or a steel disc is adhered to the upper surface of lid 272 in registration with patch 252 of pileate fastener material or magnet (FIG. 9). Patch 278 of pileate fastener material is of the "hook" variety, and thus is adapted to coact with patch 252 to couple lid 272 to sheath 224, and thus to prevent lid 272 from dropping to its horizontal position of rest unless pileate fastener patch or steel disc 278 is manually separated from pileate fastener patch or magnet 252.

Referring again to FIG. 10, the operation of the first variant of the third preferred embodiment of our invention will now be described.

As seen in FIG. 10, and described hereinabove, toilet lid 272 is affixed to sheath 224 by means of pileate fastener assembly 252, 278, or steel disc and magnet.

When, as shown in FIG. 10, bladder 222 is fully inflated by an air pressure pulse conveyed by inflating tube 232 from associated impulse converter 240 located in flush tank 230, which associated impulse converter is substantially identical to impulse converter 40 of FIG. 1.

The inflation of bladder 222, which is contained in sheath 224, impels pileate fastener assembly or magnet and steel disc 252, 278 to the left in FIG. 10, i.e., outwardly from flush tank 230.

This outward motion of pileate fastener assembly or steel disc and magnet 252, 278 correspondingly moves toilet lid 272 away from flush tank 230, and at the same time moves toilet seat 274 away from flush tank 230.

Since, as seen in FIG. 10, lid 274 is impelled beyond its stable upright position of rest, in which it leans against lid 272 which itself leans against tank 230, seat 274 falls into its horizontal position of rest on the open top of the associated toilet bowl.

However, since lid 272 is coupled to sheath 224, which is itself affixed to front wall 228 of flush tank 230, lid 272 returns to its stable upright position of rest when the air pressure pulse subsides and bladder 222 is again flattened against front wall 228 of flush tank 230 by the resilient action of sheath 224.

Thus, it will be seen that the first variant of the third preferred embodiment of our invention, as shown in FIG. 10, operates, when the equipped toilet is flushed, to lower toilet seat 274, but not lower toilet lid 272.

It is to be noted, however, that toilet lid 272 may conveniently be manually lowered, if desired, by manually separating the two parts of pileate fastener assembly or steel disc and magnet 252, 278 in the well known manner characteristic of pileate fasteners and magnets.

Referring now to FIG. 11, and comparing the same with FIG. 10, it will be seen by those having ordinary skill in the art, informed by the present disclosure, that the second variant of the third preferred embodiment of our invention differs from the first variant (FIG. 10) in that lid 272 is not secured to sheath 224 because pileate fastener patch or steel disc 278 is omitted.

In addition, in accordance with the second variant of the third preferred embodiment of our invention, toilet lid 272 is provided with two impact dampeners 282, 284, which are adhered to the extreme left and right portions of the underside of lid 272, on a line parallel to the hinge axis of lid 272.

Since pileate fastener patch or steel disc 278 is omitted, and thus lid 272 is not coupled to sheath 224, it follows that when bladder 222 is fully inflated, as shown in FIG. 11, both toilet lid 272 and toilet seat 274 are impelled to fall into their horizontal positions of rest on the bowl of the equipped toilet.

Thus, it will be seen that the apparatus of the third preferred embodiment of our invention can be selectively installed in such manner as to either (1) lower the toilet seat only (variant 1) or (2) lower the toilet seat and lid (variant 2), at the election of the installer.

It will thus be seen that the objects set forth above, among those made apparent from the preceeding description, are efficiently attained, and since certain changes may be made in the above constructions without departing from the scope of our invention it is intended that all matter contained in the above description or shown int he accompanying drawings shall be interpreted as illustrative only, and not in a limiting sense.

It is also to be understood that the following claims are intended to cover all of the generic and specific features of the invention hereindescribed, and all statements of the scope of our invention which, as a matter of language, might be said to fall therebetween.

We claim:

1. Apparatus for lowering the manually raised seat of a flush toilet in response to the flushing of the toilet, comprising toilet seat actuator means for impelling said toilet seat from its stable upright position in response to an air impulse;

impulse converter means for converting water impulses resulting from the flushing of said toilet to corresponding air impulses; and conduit means for conveying said air impulses from said impulse converter means to said seat actuator means;

said impulse converter means comprising an air chamber and a water chamber, said chambers being separated by a displaceable diaphragm.

2. Apparatus as claimed in claim 1 in which said impulse converter means comprises an air chamber and a water chamber, said chambers being separated by a displaceable diaphragm.

3. Apparatus as claimed in claim 2, further comprising resilient means for biasing said displaceable diaphragm into said water chamber.

4. Apparatus as claimed in claim 3 in which said actuator means is incorporated into the lid of seat toilet.

5. Apparatus as claimed in claim 3, further comprising conduit means for conveying water from the discharge port of the float valve of said flush toilet which is normally coupled to the standpipe of said flush toilet to said water chamber, and conduit means for conveying water from said water chamber to said standpipe.

6. Apparatus as claimed in claim 5 in which said toilet seat actuator means also impels the lid of said toilet from its stable upright position.

7. Apparatus as claimed in claim 2 in which said toilet seat actuator means also impels the lid of said toilet from its stable upright position.

8. Apparatus as claimed in claim 1 in which said toilet seat actuator means also impels the lid of said toilet from its stable upright position.

9. Apparatus as claimed in claim 1 in which said actuator means is affixed to the outer face of the front wall of the flush tank of said flush toilet and said conduit means passes between the lid and the front wall of said flush tank.

10. Apparatus as claimed in claim 9 in which said actuator means is affixed to the lid of said flush toilet.

11. Apparatus as claimed in claim 9 in which said actuator means is detachably affixed to the lid of said flush toilet.

12. Apparatus as claimed in claim 9 in which neither the lid nor the seat of said flush toilet is attached to said actuator means.

13. Apparatus for lowering the manually raised seat of a flush toilet in response to the flushing of the toilet, comprising:

toilet seat actuator means for impelling said toilet seat from its stable upright position in response to an air impulse;

impulse converter means for converting water impulses resulting from the flushing of said toilet to corresponding air impulses, said impulse converter means comprising an air chamber and a water chamber separated by a displaceable diaphragm and resilient means for biasing said displaceable diaphragm into said water chamber;

conduit means for conveying said air impulses from said impulse converter means to said seat actuator means;

conduit means for conveying water from the discharge port of the float valve of said flush toilet which is normally coupled to the standpipe of said flush toilet to said water chamber; and conduit means for conveying water from said water chamber to said standpipe.

14. Apparatus as claimed in claim 9 in which said seat actuator means is incorporated into the lid of said toilet.

15. Apparatus as claimed in claim 13 in which said toilet seat actuator means also impels the lid of said toilet from its stable upright position.

16. Apparatus for lowering the manually raised seat of a flush toilet in response to the flushing of the toilet, comprising:

toilet seat actuator means for impelling said toilet seat from its stable upright position in response to an air impulse;

impulse converter means for converting water impulses resulting from the flushing of said toilet to corresponding air impulses, said impulse converter means comprising an air chamber and a water chamber separated by a displaceable diaphragm and resilient means for biasing said displaceable diaphragm into said water chamber;

first conduit means for conveying said air impulses from said impulse converter means to said actuator means;

second conduit means for conveying water from the discharge port of the float valve of said flush toilet which is normally coupled to the standpipe of said flush toilet to said water chamber; and third conduit means for conveying water from said water chamber to said standpipe;

said first conduit means passing between the lid of the flush tank of said flush toilet and the upper edge of the front wall of said flush tank, and said toilet seat actuator means being mounted on the front face of said flush tank adjacent the raised lid of said flush toilet and attached to said raised lid.

17. Apparatus as claimed in claim 16 in which said toilet seat actuator means is attached to said raised lid by manually detachable attaching means.

18. Apparatus for lowering the manually raised seat of a flush toilet in response to the flushing of the toilet, comprising:

toilet seat actuator means for impelling said toilet seat from its stable upright position in response to an air impulse;

impulse converter means for converting water impulses resulting from the flushing of said toilet to corresponding air impulses, said impulse converter means comprising an air chamber and a water chamber separated by a displaceable diaphragm and resilient means for biasing said displaceable diaphragm into said water chamber;

first conduit means for conveying said air impulses from said impulse converter means to said actuator means;

second conduit means for conveying water from the discharge port of the float valve of said flush toilet which is normally coupled to the standpipe of said flush toilet to said water chamber; and third conduit means for conveying water from said water chamber to said standpipe;

said first conduit means passing between the lid of the flush tank of said flush toilet and the upper edge of the front wall of said flush tank, and said toilet seat actuator means being mounted on the front face of said flush tank adjacent the raised lid of said flush toilet and unattached to said raised lid.

* * * * *